US010626699B2

(12) United States Patent
Zhao

(10) Patent No.: US 10,626,699 B2
(45) Date of Patent: Apr. 21, 2020

(54) DISSOLVABLE, VARIABLE-DIAMETER METAL SEALING AND FRACTURING BRIDGE PLUG

(71) Applicant: Xi'an Well-Good Energy Technology Co., Ltd., Xi'an (CN)

(72) Inventor: Bin Zhao, Xi'an (CN)

(73) Assignee: XI'AN WELL-GOOD ENERGY TECHNOLOGY CO., LTD., Xi'an (CN)

( * ) Notice: Subject to any disclaimer, the term of this patent is extended or adjusted under 35 U.S.C. 154(b) by 1 day.

(21) Appl. No.: 16/203,626

(22) Filed: Nov. 29, 2018

(65) Prior Publication Data

US 2020/0072021 A1 Mar. 5, 2020

(30) Foreign Application Priority Data

Aug. 31, 2018 (CN) ..... 2018 1 1011448

(51) Int. Cl.

| | |
|---|---|
| ***E21B 33/134*** | (2006.01) |
| ***E21B 43/26*** | (2006.01) |
| ***E21B 33/12*** | (2006.01) |
| ***E21B 29/00*** | (2006.01) |

(52) U.S. Cl.

CPC ..... *E21B 33/134* (2013.01); *E21B 29/00* (2013.01); *E21B 33/1208* (2013.01); *E21B 43/261* (2013.01)

(58) Field of Classification Search

CPC .... E21B 33/134; E21B 33/1208; E21B 29/00; E21B 43/261

See application file for complete search history.

(56) References Cited

U.S. PATENT DOCUMENTS

2018/0171746 A1* 6/2018 Dudzinski ..... E21B 33/1285
2020/0018135 A1* 1/2020 Zeng ..... E21B 33/12

* cited by examiner

*Primary Examiner* — David J Bagnell
*Assistant Examiner* — Yanick A Akaragwe
(74) *Attorney, Agent, or Firm* — Bayramoglu Law Offices LLC

(57) ABSTRACT

A dissolvable, variable-diameter metal sealing and fracturing bridge plug includes a conical body internally provided with an axial hollow passage; a central connection shaft inserted into the hollow passage of the conical body; a slip movably installed on an external conical surface of the conical body; a tail base internally provided with two adjacent internal thread sections orderly reduced in diameter; a variable-diameter sealing ring made from a dissolvable metal and installed on a side of the slip that is close to the bottom of the conical body; and a variable-diameter supporting ring made from a dissolvable metal and installed between the variable-diameter sealing ring and the slip.

10 Claims, 4 Drawing Sheets

DISSOLVABLE, VARIABLE-DIAMETER METAL SEALING AND FRACTURING BRIDGE PLUG

CROSS REFERENCE TO THE RELATED APPLICATIONS

The present application claims priority to Chinese Patent Application No. 201811011448.8 filed on Aug. 31, 2018, the entire content of which is incorporated herein by reference.

TECHNICAL FIELD

The present invention relates to the field of oil-gas field development technologies, and particularly to a dissolvable, variable-diameter metal sealing and fracturing bridge plug with a small volume and a high dissolvability for plugging a wellbore.

BACKGROUND

In dry layers, water layers, gas layers, abnormally high-pressure layers and other special layers that appear during the execution of a formation testing in middle-shallow layers, to block an abandoned layer, such a bridge plug is usually used to seal the layer, and a permanent bridge plug is used to seal a formation-tested well for which no short-term development plan is made. Besides, the bridge plug is also used to block a tested layer of a deep-seated gas well to ensure the successful implementation of a technical process such as a shallower pool test and a fracturing reformation.

Currently, there are two main types of dissolvable wellbore plugs: dissolvable bridge plugs and dissolvable ball seats, both of which have their defects, specifically, 1: defects of dissolvable bridge plugs:

1) their sealing part is a rubber cylinder, which is difficult to be completely dissolved because of its large volume and high dissolution condition and therefore blocks a wellbore frequently in the later stage of construction and affects the oil output of an oil well;

2) their metal part has a large volume and produces many dissolved matters, blocking a wellbore easily; and 3) complicated in structure and high in production cost.

2: defects of dissolvable ball seats:

1) their construction procedures are tedious because the pre-arrangement of a working barrel is necessary;

2) the use of a specific placing tool is inevitable; and 3) high in machining precision and thus high in production cost.

SUMMARY

According to some embodiments, a dissolvable, variable-diameter metal sealing and fracturing bridge plug comprises:

a conical body, wherein, the conical body is made from a dissolvable metal and has an axial hollow passage therein, an external conical surface, and an external thread section on the top thereof;

a central connection shaft, wherein, the central connection shaft is slidably inserted into the hollow passage of the conical body and has an external thread section on an end portion thereof;

a slip, wherein, the slip is made from a dissolvable metal, the slip is provided with an internal conical surface corresponding in shape to the external conical surface of the conical body and an external surface having a radical section that is a plane, and is movably installed on the external conical surface of the conical body;

a tail base, wherein, the tail base is made from a dissolvable metal, is installed on an end of the top of the conical body and contacted with the slip, and is internally provided with two adjacent internal thread sections orderly reduced in diameter, wherein a broken interlocking thread bushing having threads on internal and external surfaces thereof is screwed at a big-diameter internal thread section, and a small-diameter internal thread section is screwed with an external thread section of the central connection shaft;

a variable-diameter sealing ring, wherein, the variable-diameter sealing ring is made from a dissolvable metal, is increased in overall diameter when internally subjected to an outward expansion force, is installed on a side of the slip that is close to the bottom of the conical body, and is provided with an internal conical surface matching with the external conical surface and the external surface having the radical section; and a variable-diameter supporting ring, wherein, the variable-diameter supporting ring is made from a dissolvable metal, is increased in overall diameter when internally subjected to an outward expansion force, is installed between the variable-diameter sealing ring and the slip, is provided with an internal conical surface matching with the external conical surface and the external surface having the radical section, and is arranged to transfer a squeezing force of the slip to the variable-diameter sealing ring and relieve the squeezing force.

In an embodiment of the present invention, an annular inwardly-recessed sealing groove is arranged on the external surface of the variable-diameter sealing ring or the variable-diameter supporting ring, and a sealing ring made from a dissolvable metal or rubber is installed in the sealing groove.

In an embodiment of the present invention, one or more variable-diameter sealing rings or variable-diameter supporting rings are arranged.

In an embodiment of the present invention, a ceramic structure having an anchoring reinforcement effect is arranged on the external surface of the slip, the ceramic structure being ceramic blocks, ceramic plates or arc-shaped ceramic sections that are arranged at intervals, and a protruding included angle is arranged on a side of the ceramic structure that faces a well wall.

In an embodiment of the present invention, a thread pitch between the threads on the external surface of the interlocking thread bushing is greater than that between the threads on the internal surface of the interlocking thread bushing, and the threads on the external surface of the interlocking thread bushing are leaning threads leaning towards the direction of the tail base.

In an embodiment of the present invention, a chamfer configured to be inserted into the inside of the interlocking thread bushing is arranged on an end portion of the external thread section of the conical body, and a space is reserved between the external surface of the interlocking thread bushing and the big-diameter internal thread section of the tail base for the inserted external thread section of the conical body to expand.

In an embodiment of the present invention, a tail end of the central connection shaft is provided with an external thread section for facilitating the connection of another device.

In an embodiment of the present invention, an end surface of the bottom of the conical body is a conical pit that is axially inwardly recessed.

In an embodiment of the present invention, the external thread section on the tail end of the central connection shaft is provided with a stop collar on an end close to the conical body, one end surface of the stop collar is a conical surface facing the conical pit, and the other end surface of the stop collar is a plane, the conical surface has a smaller taper than the conical pit, and the stop collar has a smaller diameter than the bottom of the conical body.

In an embodiment of the present invention, contact surfaces of the tail base and the slip are provided with limiting keys snapped with each other to prevent either of the tail base and the slip from rotating in a radical direction.

By sealing a wellbore using a drawing structure, the dissolvable, variable-diameter metal sealing and fracturing bridge plug provided herein has a small overall volume; the components left under a well are all made from dissolvable metals, which produces few dissolved matters at a later stage and thus is unlikely to plug the wellbore, moreover, the pre-arrangement of a working barrel is not needed, allowing the achievement of a release at any place, and the construction is simple because the dissolvable, variable-diameter metal sealing and fracturing bridge plug can be placed using a release tool and a plugging process can be completed only by controlling the magnitude of a pulling force with no need for any additional intermediate processing step.

DETAILED DESCRIPTION OF THE EMBODIMENTS

In the following description, when it comes to explaining a working mode, an end close to a well bottom is referred to as a lower end and an end close to a well head as an upper end. When it comes to explaining a structure of a bridge plug, the top of a conical body is referred to as an upper end and an end where a conical base of the conical body exists as a lower end.

Figure 1:
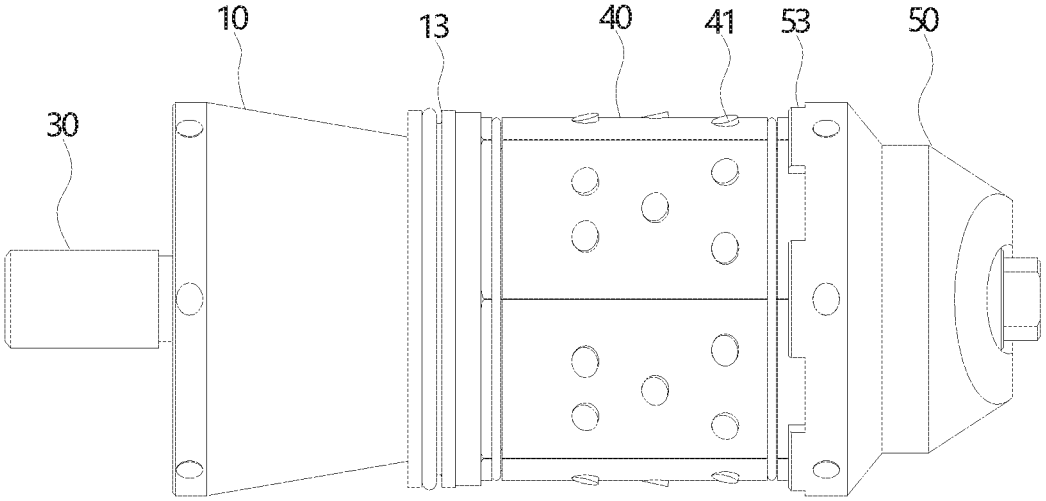
FIG. 1 is a schematic diagram illustrating a structure of a bridge plug according to an embodiment of the present invention.
Figure 2:
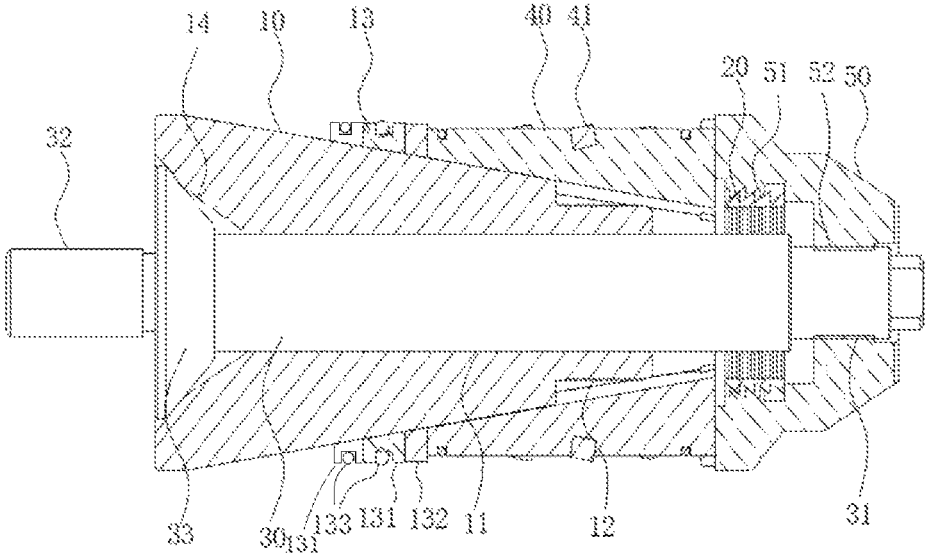
FIG. 2 is an axial cross-sectional view of an unset bridge plug according to an embodiment of the present invention.

As shown in FIG. 1 and FIG. 2, a dissolvable, variable-diameter metal sealing and fracturing bridge plug according to an embodiment of the present invention generally comprises a conical body 10, a central connection shaft 30, a slip 40, a tail base 50 and a sealing element 13.

Figure 4:
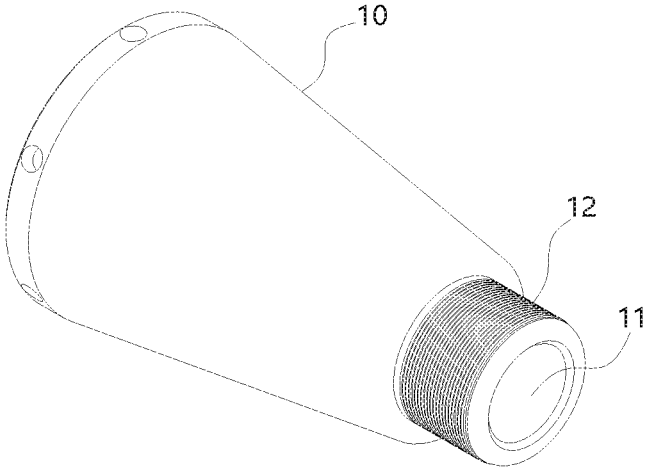
FIG. 4 is a schematic diagram illustrating a three-dimensional structure of a conical body according to an embodiment of the present invention.

As shown in FIG. 4, the inside of the conical body 10 is provided with an axial hollow passage 11 running through the conical body, an external surface of the conical body 10 is a circular external conical surface, an external thread section 12 is arranged on the top of the conical body, and the diameter of the bottom of the conical body is smaller than the inner diameter of a wellbore to be plugged.

The central connection shaft 30 is slidably inserted into the hollow passage 11 of the conical body 10, and an external thread section 31 is arranged on an end portion of the central connection shaft 30 and extends out of the top of the conical body.

The slip 40, whose internal surface is an internal conical surface matching in shape with the external conical surface of the conical body 10 and external surface is a circular plane, is movably sleeved on the external conical surface of the conical body 10.

Figure 5:
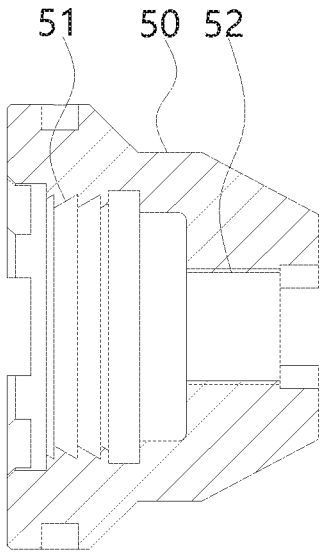
FIG. 5 is a cross-sectional view of a tail base according to an embodiment of the present invention.
Figure 6:
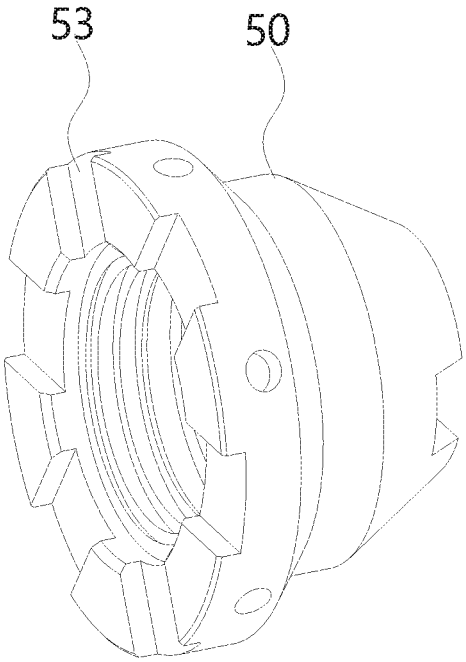
FIG. 6 is a schematic diagram illustrating a three-dimensional structure of a tail base according to an embodiment of the present invention.

As shown in FIG. 5 and FIG. 6, the tail base 50 is positioned on the side of the top of the conical body 10 and internally provided with two adjacent internal thread sections 51 and 52 orderly reduced in diameter, wherein a broken interlocking thread bushing 20 having threads on internal and external surfaces thereof is screwed at the big-diameter internal thread section 51, the small-diameter internal thread section 52 is screwed with the external thread section 31 extending out of the central connection shaft 30, and the installed tail base 50 is contacted with the slip 40 to prevent the slip 40 from departing from the conical body 10.

The sealing element 13 comprises a variable-diameter sealing ring 131 and a variable-diameter supporting ring 132, wherein the variable-diameter sealing ring 131 is made from a dissolvable metal and can be increased in overall diameter when an internal surface thereof moves towards the bottom of the conical body 10 along the external conical surface of the conical body 10, specifically, the sealing element 13 is installed on a side of the slip 40 that is close to the bottom of the conical body 10, and has an internal conical surface matching with the external conical surface of the conical body 10 and an external surface having a radical section that is a plane.

The variable-diameter supporting ring 132 is also made from a dissolvable metal and also can be increased in overall diameter when an internal surface thereof moves towards the bottom of the conical body 10 along the external conical surface of the conical body 10, the variable-diameter supporting ring 132 is installed between the variable-diameter sealing ring 131 and the slip 40, and has an internal conical surface matching with the external conical surface and the external surface having the radical section; and the variable-diameter supporting ring 132 is arranged to transfer a squeezing force of the slip 40 to the variable-diameter sealing ring 131 and relieve the squeezing force of the slip 40 in a later setting process to prevent the variable-diameter sealing ring 131 from being fractured by the slip 40 to affect a sealing effect.

After being installed, the bridge plug according to the embodiment is structured as follows: the central connection shaft 30 is inserted into the hollow passage 11 of the conical body 10, the slip 40 is sleeved on the external conical surface of the conical body 10, with the contact therebetween being a sliding contact, the interlocking thread bushing 20 is screwed at the big-diameter internal thread section 51 of the tail base 50, the tail base 50 is screwed on the external thread section 12 of the central connection shaft 30 through the small-diameter internal thread section 52, the installed tail base 50 is contacted with the slip 40 to prevent the slip 40 from sliding out of the external conical surface of the conical body 10, and the variable-diameter sealing ring 131 and the variable-diameter supporting ring 132 are orderly installed on an external conical surface of the slip 40 that is opposite to another side of the tail base 50 and is contacted with another side of the slip 40. At this time, the top of the conical body 10 is a certain distance from the tail base 50, wherein the distance is equal to a distance the slip 40 needs to move to be completely attached with an internal wall of the wellbore.

When in use, the bridge plug needs to be used in conjunction with a currently common mainstream bridge plug setting tool, with which the bridge plug can be placed at a corresponding position of a wellbore to be plugged with the tail base 50 facing down, a squeezing sleeve of the setting tool props against an end surface of the bottom of the conical body 10 to make the end surface immobile, a central rod of the setting tool is connected with the central connection shaft 30 to apply a certain pulling force to the central connection shaft 30 through the setting tool so that the central connection shaft 30 pulls, through the thread connection with the tail base 50, the tail base 50 to move towards a well head while the conical body 10 keeps motionless, and the conical body 10 and the tail base 50 have a relative motion relation with each other. When moving, the tail base 50 pushes the slip 40 to move towards the bottom of the conical body 10 along the external conical surface of the conical body 10 and synchronously drives the variable-diameter sealing ring 131 and the variable-diameter supporting ring 132 to move along the external conical surface as well, and when moving, each of the slip 40, the variable-diameter sealing ring 131 and the variable-diameter supporting ring 132 increases its body as the angle of the external conical surface increases, and gradually contacts with a well wall until completely attached tightly with the well wall to form a corresponding sealing structure.

During the process of pulling the tail base 50, the internal interlocking thread bushing 20 gradually approaches the external thread section 12 of the conical body 10 until squeezed to be sleeved on the external thread section 12 of the conical body 10, thereby fixing the conical body 10 with the tail base 50 through the interlocking thread bushing 20.

The first stage of the current bridge plug setting is completed when the variable-diameter sealing ring 131, the variable-diameter supporting ring 132 and the slip 40 are closely contacted with the well wall and the external thread section 12 of the conical body 10 is entirely inserted into the interlocking thread bushing 20. The slip 40 has a certain effect in sealing and anchoring the well wall, the external surface of the variable-diameter sealing ring 131 completely seals the well wall, and the internal surface of the variable-diameter sealing ring 131 can seal the external conical surface; and when transferring a squeezing force of the slip 40, the variable-diameter supporting ring 132 bears a direct pressure of the slip 40, not affecting the sealing effect of the variable-diameter sealing ring 131 even if broken.

Figure 3:
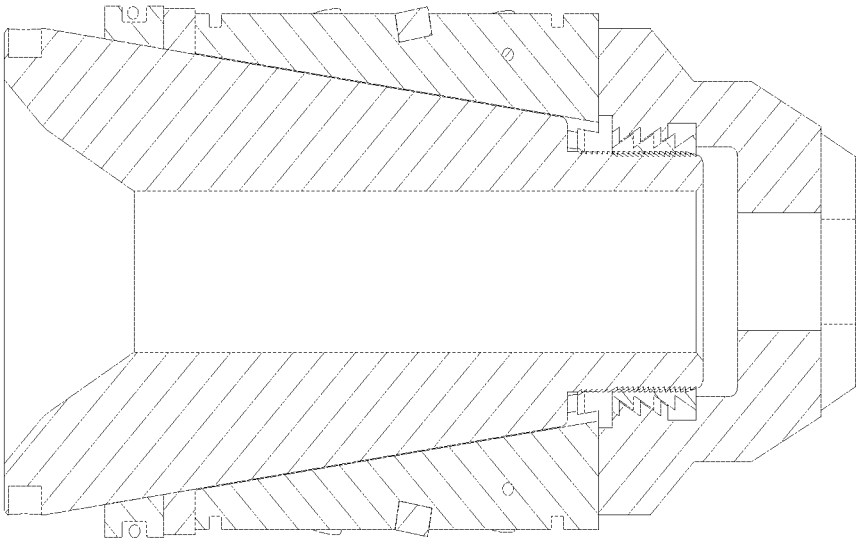
FIG. 3 is an axial cross-sectional view of a set bridge plug according to an embodiment of the present invention.

The tail base 50 continues to be applied with a puling force, as the pulling force applied by the setting tool to the central connection shaft 30 keeps increasing, respective components no longer motion relative to each other, thus, the generated pulling force is directly transferred from the central connection shaft 30 to the position where the central connection shaft 30 is connected with the tail base 50 through threads; when the pulling force is greater than the thread connection force between the central connection shaft 30 and the tail base 50, the external thread section 31 of the central connection shaft 30 is pulled out of the small-diameter internal thread section 52 of the tail base 50 and taken out of a well along with the setting tool while the conical body 10, the slip 40, the sealing element 13 and the tail base 50 are kept in place, as shown in FIG. 3; after the central connection shaft 30 is pulled out, a circular dissolvable metal ball sealer can be dropped directly from the well head to directly seal the hollow passage 11 of the conical body 10, then a downhole bridge plug setting process is completed. The hollow passage 11 sealed by the ball sealer prevents a fracturing fluid from flowing out in a later fracturing implementation process, the contact with the well wall is sealed by the variable-diameter sealing ring 131, the variable-diameter supporting ring 132 and the slip 40, thereby ensuring the smooth implementation of a fracturing operation.

The dissolvable metal is a magnesium-aluminum alloy in the embodiment, and may be another alloy reaching a dissolution standard in another embodiment. All components except the central connection shaft may be made from a dissolvable metal so that the used bridge plug can be wholly dissolved in a later stage after the central connection shaft is pulled out, causing no wellbore plugging. To facilitate the connection of a central rod of the setting tool, a tail end of the central connection shaft 30 may be provided with an external thread section 32 with external threads, so that the central rod can be directly screwed on the external thread section 32 of the central connection shaft 30 via a thread bushing. Connectors such as chains and pin shafts may be used in other embodiments.

By sealing a wellbore using a drawing structure, the dissolvable, variable-diameter metal sealing and fracturing bridge plug according to the embodiment has a small overall volume; the components left under a well are all made from dissolvable metals, which produces few dissolved matters at a later stage and thus is unlikely to plug the wellbore, moreover, the pre-arrangement of a working barrel is not needed, allowing the achievement of a release at any place, and the construction is simple because the dissolvable, variable-diameter metal sealing and fracturing bridge plug can be placed using a release tool and a plugging process can be completed only by controlling the magnitude of a pulling force with no need for any additional intermediate processing step.

Further, to improve the anchoring effect of the slip 40, a corresponding ceramic structure 41, which may be ceramic blocks, ceramic plates or arc-shaped ceramic sections that are arranged at intervals, may be arranged on an external surface of the slip 40, the ceramic structure 41 can be forcedly jacked into the well wall when the slip 40 is closely contacted with the well wall, thereby enhancing the stability of the connection between the slip 40 and the well wall to reduce the possibility of movement. To facilitate the clamping of the ceramic structure 41 into the well wall, a protruding included angle may be arranged on a side of the ceramic structure 41 facing the well wall, here, the included angle is an angle that is more likely to centralize a squeezing force such as an acute angle, an obtuse angle, a corner angle, and the like. A layer of solid coating may be sprayed or electroplated on an external surface of the slip to increase the firmness of the contact with the well wall.

In an embodiment of the present invention, to improve the sealing effect of the sealing element 13, a sealing groove 133 having a rectangular section may be arranged on an external surface of the variable-diameter sealing ring 131 and/or an external surface of the variable-diameter supporting ring 132, and a sealing ring, which may be made from a dissolvable metal or rubber, is installed in the sealing groove. If the sealing ring is made from a dissolvable metal, the bridge plug according to the embodiment is totally rubber-free, which can thoroughly solve the problem that existing bridge plugs have a big volume and are not easy to dissolve. However, if the sealing ring is made from rubber, the amount of the used rubber is only 1/20 of the rubber amount of an existing dissolvable bridge plug, also achieving an effect of significantly reducing the volume of a bridge plug and decreasing phenomena that a bridge plug cannot be dissolved.

To cope with the sealing requirements made in different environments, one or more variable-diameter sealing rings 131 and/or the variable-diameter supporting rings 132 may be installed, and similarly, the number of the sealing grooves may be correspondingly set according to an installation number.

Figure 7:
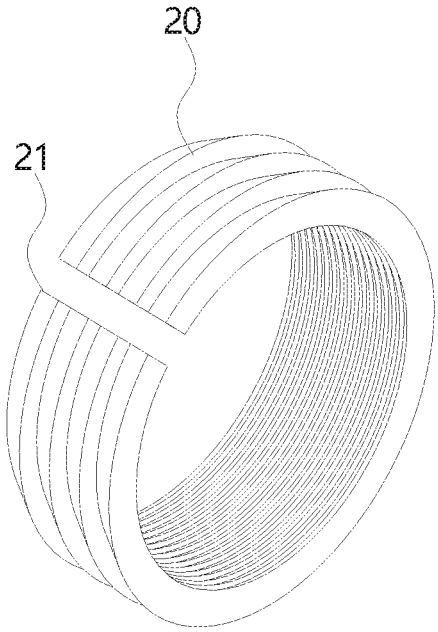
FIG. 7 is a schematic diagram illustrating a three-dimensional structure of an interlocking thread bushing according to an embodiment of the present invention.

As shown in FIG. 7, in an embodiment of the present invention, to increase the engaging force between the tail base 50 and the interlocking thread bushing 20, a thread pitch between the threads on the external surface of the interlocking thread bushing 20 may be greater than that between the threads on the internal surface of the interlocking thread bushing 20, that is, the thread pitch between the threads on the external surface of the interlocking thread bushing 20 may be different from that between the threads on the internal surface of the interlocking thread bushing 20, and the threads on the external surface of the interlocking thread bushing 20 can provide a greater engaging force. Further, the threads on the external surface of the interlocking thread bushing 20 may be leaning threads leaning towards the tail base 50. This structure makes threads opposite to a pulling direction, thereby providing a stronger thread engaging force.

Further, a chamfer configured to be inserted into the inside of the interlocking thread bushing 20 may be arranged on an end portion of the external thread section 12 of the conical body 10, and a space is reserved between an external surface of the interlocking thread bushing 20 and the big-diameter internal thread section 51 of the tail base 50 that are connected with each other, in order for the interlocking thread bushing 20 to expand after the external thread section 12 of the conical body 10 is inserted.

When the tail base 50 is pulled towards the bottom of the conical body 10, the interlocking thread bushing 20 approaches and is sleeved on the top of the conical body 10, at this time, the chamfer can help the external thread section 12 at the top of the conical body to enter the interlocking thread bushing 20, in the process that the external thread section 12 gets into the interlocking thread bushing 20, the interlocking thread bushing 20 expands outwardly because of the broken structure, and is finally propped against the big-diameter internal thread section 51 of the tail base 50 by the external thread section 12 that is entirely squeezed into the interlocking thread bushing 20, thereby forming a close connection among the interlocking thread bushing 20, external thread section 12 and the big-diameter internal thread section 51.

Further, limiting keys 53 may be arranged on contacted end surfaces of the tail base 50 and the slip 40 to prevent the tail base 50 and the slip 40 from rotating in a radial direction with respect to each other, specific limiting keys 53 may be an inwardly-recessed rectangular groove and a corresponding bump that are arranged on contact surfaces of the tail base 50 and the slip 40, respectively, when the tail base 50 and the slip 40 are contacted with each other, the bump is inserted into the corresponding rectangular groove, thereby forming a resistance to a radical rotation of either of the tail base 50 and the slip 40, so that the tail base 50 and the slip 40 can only rotate synchronously. In other embodiments, the limiting keys 53 may also be a cylinder and a pit that are corresponding to each other, and like structures.

In an embodiment of the present invention, an end surface of the bottom of the conical body 10 may be a conical pit 14 that is axially inwardly recessed. A ball sealer made from a dissolvable metal falls naturally onto the center of the conical pit 14, thereby successfully plugging the hollow passage 11.

Figure 8:
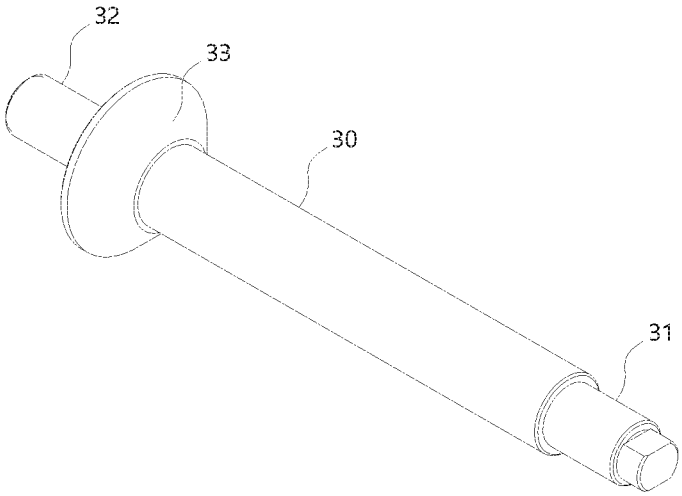
FIG. 8 is a schematic diagram illustrating a three-dimensional structure of a central connection shaft according to an embodiment of the present invention.

As shown in FIG. 8, in an embodiment of the present invention, an annular stop collar 33 may be fixed on an end of the external thread section 32 of the tail end of the central connection shaft 30 that is close to the conical body 10, an end of the stop collar 33 facing the bottom of the conical body 10 is a conical surface, the other end of the stop collar 33 is a plane, and the conical surface has a smaller taper than the conical pit 14, so as to form a hollow chamber after the conical surface of the stop collar 33 is contacted with the conical pit 14; the stop collar 33 has a smaller diameter than the bottom of the conical body 10 to avoid affecting the movement of the slip 40. The stop collar 33 is fixedly connected with the central connection shaft 30 to share a pulling force subjected by the central connection shaft 30, and the plane end of the stop collar 33 can limit the screwing length of the central rod of the setting tool.

Besides, friction patterns may be arranged on the plane of the stop collar 33 to improve the contact of the stop collar 33 with a setting tool.

It should be appreciated by those skilled in the art that although a plurality of exemplary embodiments of the present invention are elaborated and described herein, a variety of other variations or modifications conforming to the principles of the present invention may be directly determined or derived according to the contents disclosed herein without departing from the spirit and scope of the present invention. Therefore, it should be understood and affirmed that the scope of the present invention covers all such variations or modifications.

What is claimed is:

1. A dissolvable, variable-diameter metal sealing and fracturing bridge plug, comprising:

a conical body, wherein, the conical body is made from a dissolvable metal and has an axial hollow passage therein, an external conical surface, and an external thread section on the top thereof;

a central connection shaft, wherein, the central connection shaft is slidably inserted into the hollow passage of the conical body and has an external thread section on an end portion thereof;

a slip, wherein, the slip is made from a dissolvable metal, the slip is provided with an internal conical surface corresponding in shape to the external conical surface of the conical body and an external surface having a radical section that is a plane, and is movably installed on the external conical surface of the conical body;

a tail base, wherein, the tail base is made from a dissolvable metal, is installed on an end of the top of the conical body and contacted with the slip, and is internally provided with two adjacent internal thread sections orderly reduced in diameter, wherein a broken interlocking thread bushing having threads on internal and external surfaces thereof is screwed at a big-diameter internal thread section, and a small-diameter internal thread section is screwed with an external thread section of the central connection shaft;

a variable-diameter sealing ring, wherein, the variable-diameter sealing ring is made from a dissolvable metal, is increased in overall diameter when internally subjected to an outward expansion force, is installed on a side of the slip close to the bottom of the conical body, and is provided with an internal conical surface matching with the external conical surface and the external surface having the radical section; and a variable-diameter supporting ring, wherein, the variable-diameter supporting ring is made from a dissolvable metal, is increased in overall diameter when internally subjected to an outward expansion force, is installed between the variable-diameter sealing ring and the slip, is provided with an internal conical surface matching with the external conical surface and the external surface having the radical section, and is arranged to transfer a squeezing force of the slip to the variable-diameter sealing ring and relieve the squeezing force.

2. The dissolvable, variable-diameter metal sealing and fracturing bridge plug according to claim 1, wherein an annular inwardly-recessed sealing groove is arranged on the external surface of the variable-diameter sealing ring or the variable-diameter supporting ring, and a sealing ring made from a dissolvable metal or rubber is installed in the sealing groove.

3. The dissolvable, variable-diameter metal sealing and fracturing bridge plug according to claim 2, wherein more than one variable-diameter sealing ring or variable-diameter supporting ring is arranged in the sealing groove.

4. The dissolvable, variable-diameter metal sealing and fracturing bridge plug according to claim 1, wherein a ceramic structure having an anchoring reinforcement effect is arranged on the external surface of the slip, the ceramic structure being ceramic blocks, ceramic plates or arc-shaped ceramic sections are arranged at intervals, and a protruding included angle is arranged on a side of the ceramic structure that faces a well wall.

5. The dissolvable, variable-diameter metal sealing and fracturing bridge plug according to claim 1, wherein a thread pitch between the threads on the external surface of the interlocking thread bushing is greater than that between the threads on the internal surface of the interlocking thread bushing, and the threads on the external surface of the interlocking thread bushing are leaning threads leaning towards the direction of the tail base.

6. The dissolvable, variable-diameter metal sealing and fracturing bridge plug according to claim 1, wherein a chamfer configured to be inserted into the inside of the interlocking thread bushing is arranged on an end portion of the external thread section of the conical body, and a space is reserved between the external surface of the interlocking thread bushing and the big-diameter internal thread section of the tail base for the inserted external thread section of the conical body to expand.

7. The dissolvable, variable-diameter metal sealing and fracturing bridge plug according to claim 1, wherein a tail end of the central connection shaft is provided with an external thread section for facilitating the connection of another device.

8. The dissolvable, variable-diameter metal sealing and fracturing bridge plug according to claim 7, wherein an end surface of the bottom of the conical body is a conical pit that is axially inwardly recessed.

9. The dissolvable, variable-diameter metal sealing and fracturing bridge plug according to claim 8, wherein the external thread section on the tail end of the central connection shaft is provided with a stop collar on an end close to the conical body, one end surface of the stop collar is a conical surface facing the conical pit, and the other end surface of the stop collar is a plane, the conical surface has a smaller taper than the conical pit, and the stop collar has a smaller diameter than the bottom of the conical body.

10. The dissolvable, variable-diameter metal sealing and fracturing bridge plug according to claim 1, wherein contact surfaces of the tail base and the slip are provided with limiting keys snapped with each other to prevent either of the tail base and the slip from rotating in a radical direction.

* * * * *